United States Patent [19]

Schlapp

[11] 4,049,330

[45] Sept. 20, 1977

[54] STORAGE FACILITY

[76] Inventor: Wilhelm Schlapp, Schulstr. 8, D-6392 Neu-Anspach 1, Germany

[21] Appl. No.: 669,807

[22] Filed: Mar. 24, 1976

[51] Int. Cl.[2] ..... A47B 63/00; A47F 1/00

[52] U.S. Cl. ..... 312/186; 312/305; 312/197; 312/97.1

[58] Field of Search ..... 312/186, 183, 197, 187, 312/11, 305, 97.1

[56] References Cited

U.S. PATENT DOCUMENTS

| | | | |
|---|---|---|---|
| 1,079,173 | 11/1913 | Heffner | 312/305 |
| 1,417,578 | 5/1922 | Smith | 312/97.1 |
| 2,496,490 | 2/1950 | Phillips | 312/305 |
| 2,496,491 | 2/1950 | Phillips | 312/305 |
| 2,711,741 | 6/1955 | Wassell | 312/183 |
| 2,792,147 | 5/1957 | Stewart | 312/97.1 |
| 2,796,263 | 6/1957 | Moore | 312/11 |
| 2,975,014 | 3/1961 | Dahl | 312/186 |
| 3,279,471 | 10/1966 | Ruina | 312/186 |
| 3,334,950 | 8/1967 | Brownlee | 312/97.1 |
| 3,747,754 | 7/1973 | Nix et al. | 312/197 |

*Primary Examiner*—Paul R. Gilliam
*Assistant Examiner*—Victor N. Sakran
*Attorney, Agent, or Firm*—Ralf H. Siegemund

[57] ABSTRACT

A storage facility for files or other papers is constructed as a horizontally rotatable drum with radial compartments of variable size, possibly arranged in several radial levels. The drum may be enclosed, motor-driven and position-controlled.

7 Claims, 10 Drawing Figures

STORAGE FACILITY

BACKGROUND OF THE INVENTION

The present invention relates to easy-access storage facilities for storing objects, such as forms, papers, files, merchandise, etc.

A typical situation in which the need for an easy-access storage facility arises, exists, for example, in administrative offices in which numerous folders, files, forms, brochures, letters, etc. must be readily available to a clerk without having to get up, etc. It is known to provide desks with telescopic drawers and compartments, but the capacity of such facilities is usually quite limited due to and by the usual desk sizes. Another easy-access storage facility is of the lazy susan variety with a vertical axis; but again the capacity is quite limited. One can provide such a device with several vertically spaced storage levels, but there obviously exists a reasonable height limit. For example, highly placed levels may actually be out or reach.

DESCRIPTION OF THE INVENTION

It is an object of the present invention to provide a new and improved easy-access storage facility having a rather large storage capacity and being particularly easily to reach, e.g. from one particular point.

It is another object of the present invention to provide a new and improved easy-access storage facility for use in offices and elsewhere, commensurate with the needed capacity, on the one hand, and the available space on the other hand, taking into consideration that access should require a minimum of steps of the personnel.

In accordance with the preferred embodiment of the present invention it is suggested to provide a drum which is closed around its circumference but open at least at one of its two ends. The drum is mounted for rotation about a horizontal axis and the interior of the drum is partitioned into sectors by means of displaceable, radially extending walls.

Such a drum can be quite large and it may be desirable to provide for further partitioning by means of inner, tubular, coxial partitions. The term "large" is, of course, a relative statement and should be understood in the present context as being related to the size of the objects to be stored, an additional factor being the available space for placement of such a facility.

The storage facility can readily be constructed in various sizes. Desk size or cabinet size for placement next to the desk is the preferred form of practicing the invention, particularly as far as satisfying the need is concerned out of which the invention was developed. On the other hand, the principle of the invention is applicable also to large size storage facilities extending e.g. over the entire height of a room.

Depending on the dimensions of the drum, the latter may be motor-driven, and in a more sophisticated system the motor may be subject to positioning control, with preselection of particular compartments of storage. The drum may be contained in an enclosure having access slots and possibly ejection devices. The storage facility may readily be protected against unauthorized use as well as against accidents of various kinds.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIGS. 1 and 2 depict a drum 1 having a circumferential, tubular wall 2 actually constituting the drum proper and having a closed rear end wall 3. The opposite end of the drum 1 is open for access, and FIG. 1 is a view into the storage drum from that open end. The drum has a hub member 4, which extends from the bottom 3. A shaft 4*a* traverses the hub for rotatably mounting the shaft and the drum in a stand 4*b*.

The interior of the drum defines an annular storage space which is partitioned into compartments by means of walls or partitions 5. These partitions extend from hub 4 all the way to drum wall 2. The radial height of the partitions, i.e. the distance between hub 4 and wall 2 and the inner axial depth of the drum (annular storage space) are, for example, chosen to accommodate regular letter size documents, papers, folders, etc.

Figure 4:
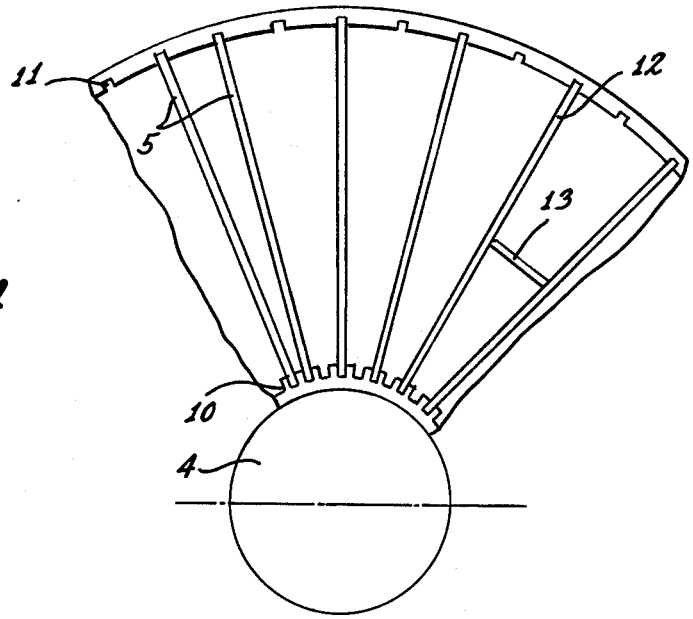
FIG. 4 is a front view of a portion of a storage drum showing details on an enlarged scale.

FIG. 4 shows the construction of the compartments in greater detail. The hub 4 is provided with a sleeve 10*a* having axial grooves 10 into which are placed the portions 5. In particular, they are just slid in. The inner surface of drum 2 is also provided with grooves 11, which face individually the grooves 10 radially across the inner space of the drum. The partitions 5 are also slid into the grooves 10.

It can readily be seen that there are more grooves that partitions. This serves to illustrate that placement of partitions can be chosen in accordance with the need for separate compartments on the one hand, and with the dimensions of the paper bundles to be stored in the same compartment on the other hand. Also, ring binders may be stored and it can readily be seen that the usually somewhat wider back of a not completely filled binder can readily be accommodated adjacent to the radial outer portion of any compartment.

One can also see that binders with hard covers can be used themselves as partitions in that the edges of the binders are slid into the slots 10 (or 11).

Another variant is implicit in FIG. 4. Not all of the partitions 5 need to be of the slide-in variety; some of them may be permanently installed. If, for example, three or more such partitions are bonded or otherwise affixed to the sleeve 10*a* and the drum body 2 then these particular partitions may also carry the drum itself. In this case one does not need the bottom 3, and access is possible from both sides, which in turn means that the drum could be twice as long as the length of usual files, documents, etc.

The FIG. 4 shows also that special pairs 12 of walls can be provided having a lateral, internal partitioning 13, so that, for example, a full size (radial) compartment is not wasted on smaller items.

Figure 1:
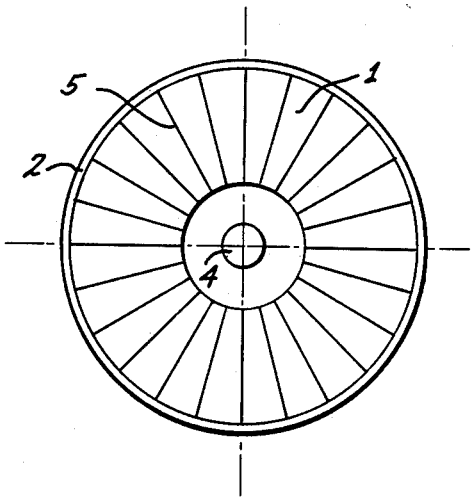
FIG. 1 is a front view of a storage facility in accordance with the preferred embodiment showing particularly a drum as seen from its one open end.
Figure 2:
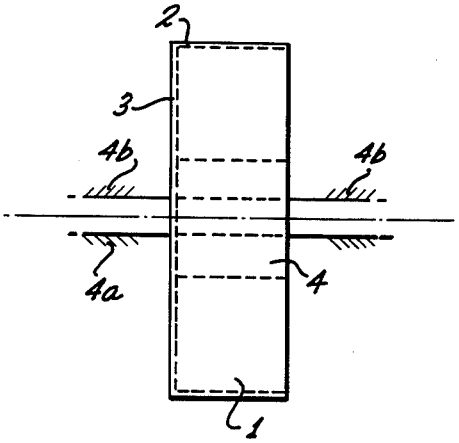
FIG. 2 is a side view of the drum shown in FIG. 1.
Figure 3:
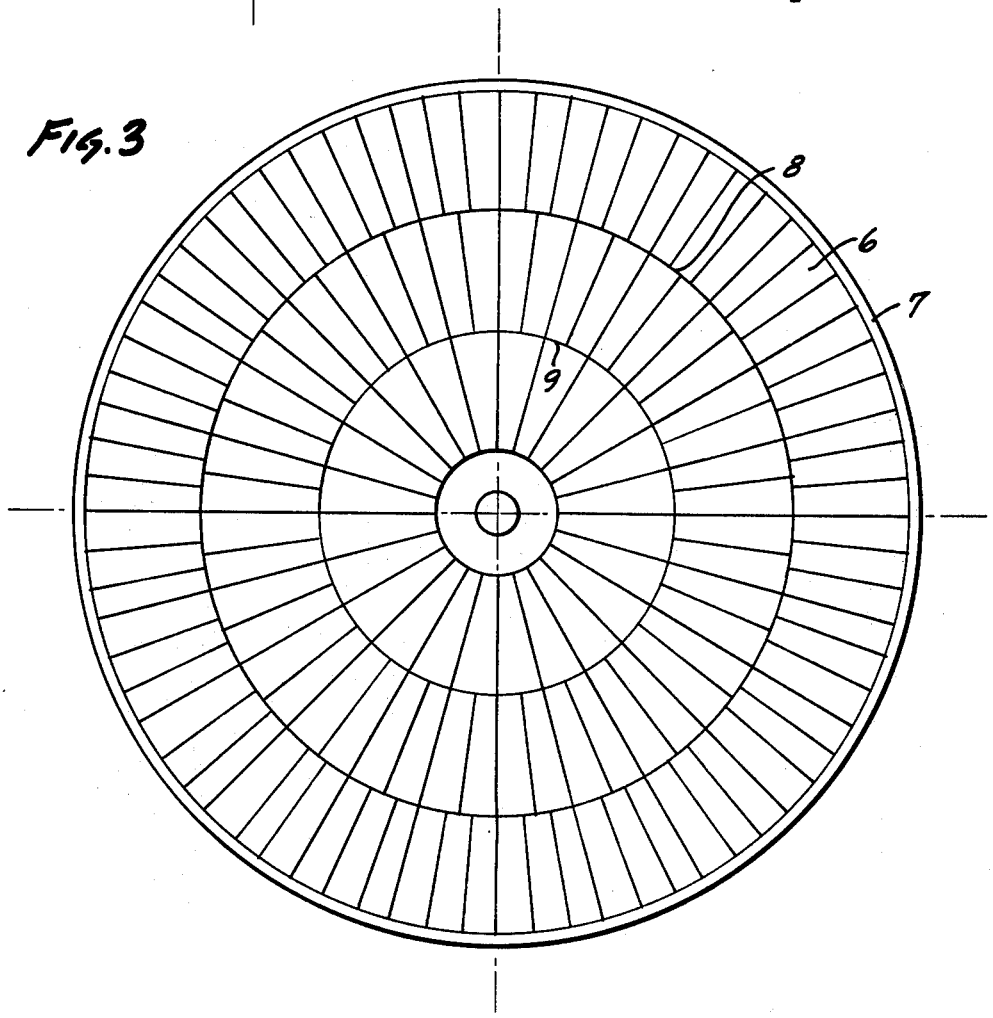
FIG. 3 is a front view of a larger drum with multiple coaxial partitions.

FIG. 3 illustrates a mode of capacity enlargement of the storage facility in that the interior of drum 1 is additionally partitioned by coaxial, tubular walls, such as 8 and 9, to obtain three annular sub-storage facilities. The radial height of each such annular sub-facility is preferably slightly larger than the one dimension of the objects to be stored. If the entire drum is large, then this height may equal the width of a regular folder or hard cover ring binder.

These annular or tubular walls 8 and 9 are each provided on their inside with grooves, such as 11 in FIG. 4 and on their outside with grooves, such as 10. The groove pattern is not necessarily in one to one, radial alignment as far as the different annular storage facilities are concerned. It can also be seen that in a large capacity drum such as this, the outer compartments taper very little in radially inward direction.

Figure 5:
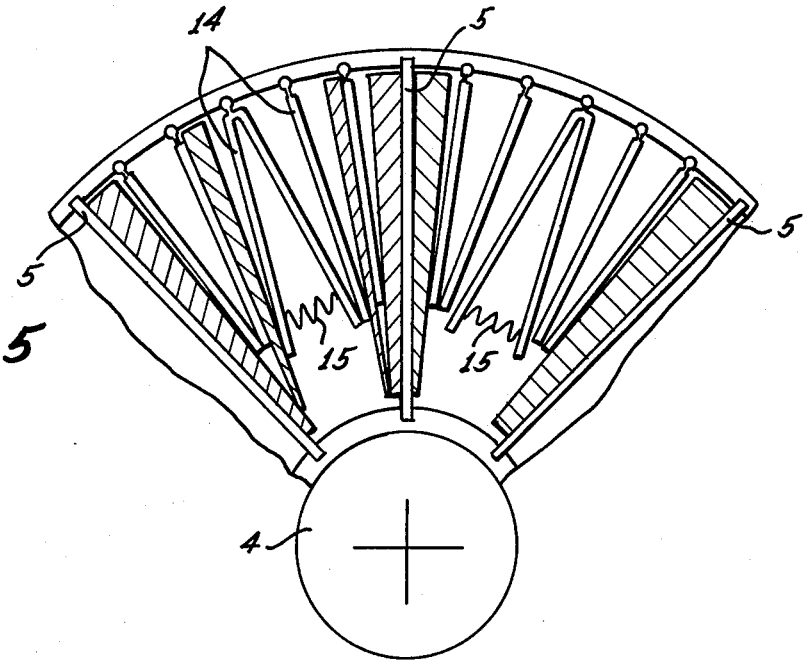
FIG. 5 is a view similar to FIG. 4, but showing modified details.

FIG. 5 shows a modification primarily of the groove pattern in the outer drum. The walls or partitions 5 are provided as before, but in-between the particular grooves 11 receiving the partitions 5, there are provided undercut grooves from which are suspended particular partitions 14, which do not extend all the way down to the hub. These partitions can pivot to some extent, and springs, such as 15 are suitably interposed to urge such partitions 14 against others, or against stored objects to thereby hold these objects more firmly in their respective compartment. This way these objects will be held in position particularly upon turning of the drum.

The undercut grooves may also serve as rails, or such rails can be installed so that folders with suitable backing can be suspended just like the partitions 14. The rails are preferably provided with stops, corrugation beads or the like in order to avoid shifting of folders upon turning of the drum. The open end edges of these folders may again be guided and held by grooves 10, so that the folders will not flap around when the drum is turned.

The storage facilities as described thus far are more or less open which means that dust can readily gather in the compartments and on the objects therein. Also, there is some danger of an accident as objects may not have been pushed sufficiently far and may fall out upon turning the drum e.g. too rapidly. Thus, it may be advisable to encase the storage facility.

Figure 6:
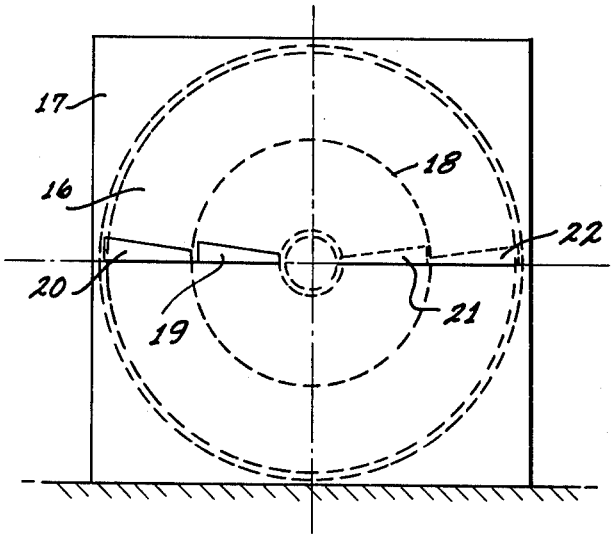
FIG. 6 is a front view of an enclosed storage facility with horizontally rotatable drum.
Figure 10:
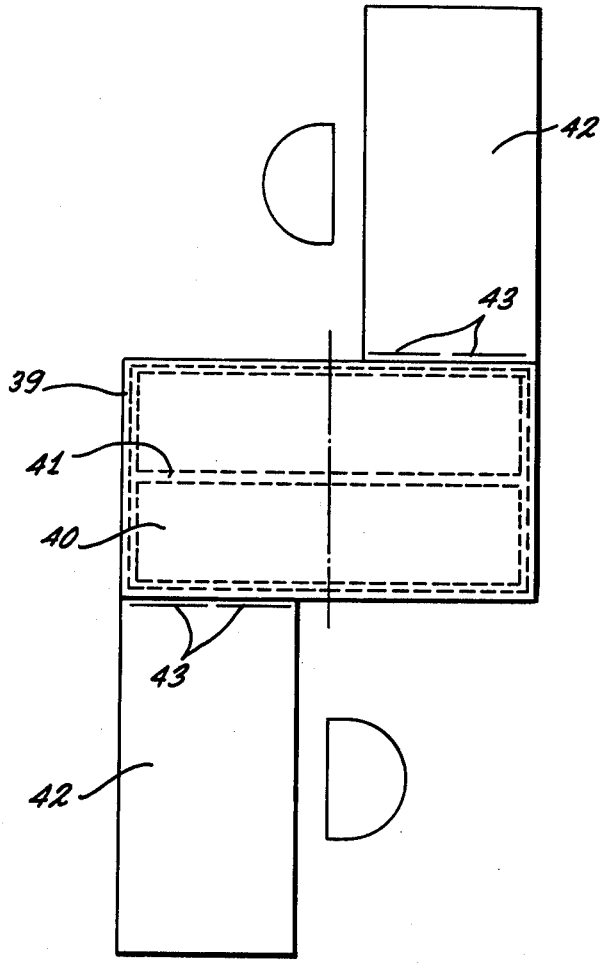
FIG. 10 shows somewhat schematically a top view of two desks with a common storage facility as per the present invention.

FIG. 6 shows a drum 16, which could be constructed as outlined with reference to any of the examples described above. However, the drum is enclosed by a casing, enclosure or cover 17. The drum is particularly provided with two concentric sub-storage facilities by operation of the tubular divider 18. Accordingly, the enclosure 17 is provided with access slots, such as 19 and 20 being located in the front wall, and 21 and 22 in the rear or opposite wall of the enclosure. The slots 19 etc. are preferably provided in the "working" level of the person needing easy access. By way of example, if the store is placed next to a desk, then these slots 19 etc. should be in about the level of the top of the desk. FIG. 10 shows by way of example how a drum can be placed next to two desks and the two pairs of access slots denoted here 43 are used by the two clerks on both sides of the facility. If the drum is large and/or placed in a file room it may be advisable to have the slots in vertical directions near the top of the case 17 of FIG. 6.

Figure 7:
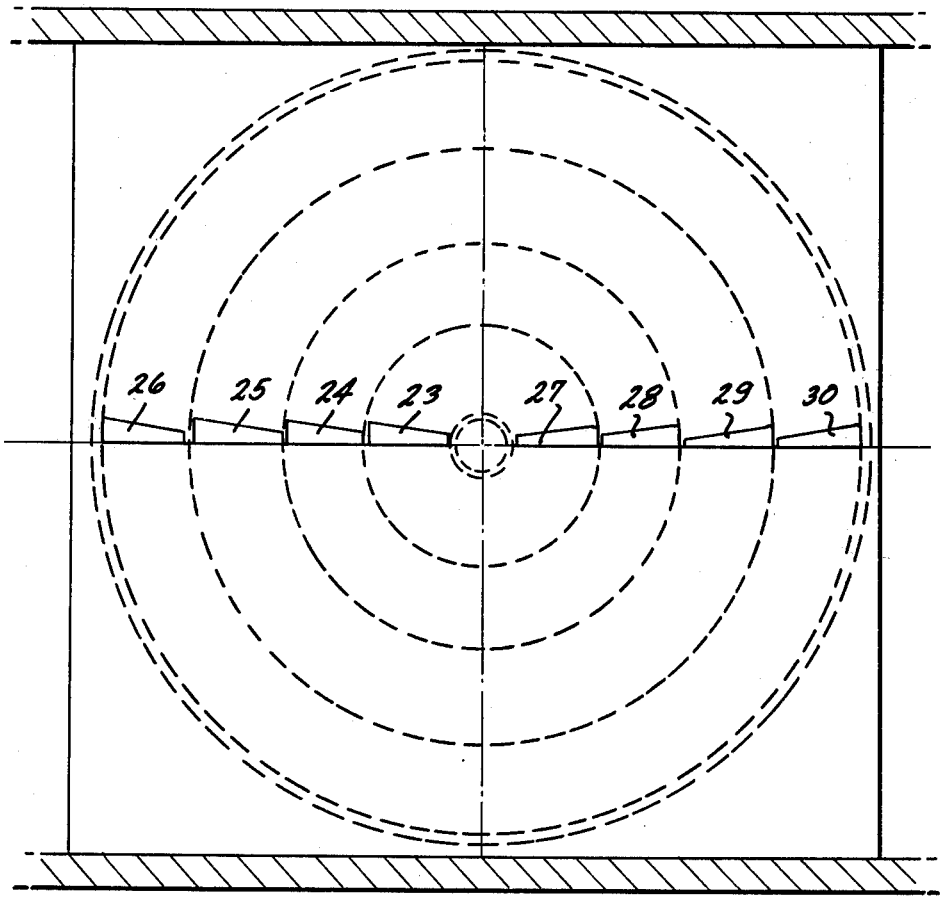
FIG. 7 shows somewhat schematically a very large storage facility occupying the entire height dimensions of a room.

FIG. 7 shows a storage drum that runs from the floor to the ceiling. The shaft for the drum may be journalled in the rear wall. The drum is partitioned into four annular sub-spaces. Multiple slots in the front wall of the facility are provided also here, 23 through 30, whereby each annular sub-space is accessible by two slots in the front wall in order to reduce access time. A maximum of a quarter turn is needed only for access to any storage space from any prior position of the drum.

It will be appreciated that small storage drums are readily movable by hand. Larger units, however, require motor-driven operation. Thus, the shaft may be constructed to be a hollow shaft in which is mounted a drive motor being e.g. of the self-locking, geared variety. The motor may be controlled manually in simple fashion and operated in stop-go modes with stopping of the drum occurring when the operator sees that the desired item is available. However, for large systems use of an automated positioning control may be advisable.

Figure 8:
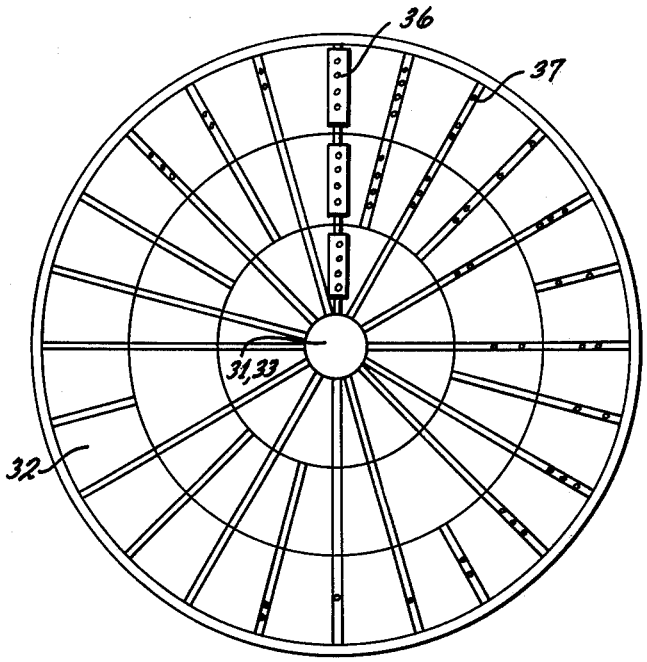
FIG. 8 is a front view of a storage facility showing also means for positioning control.
Figure 9:
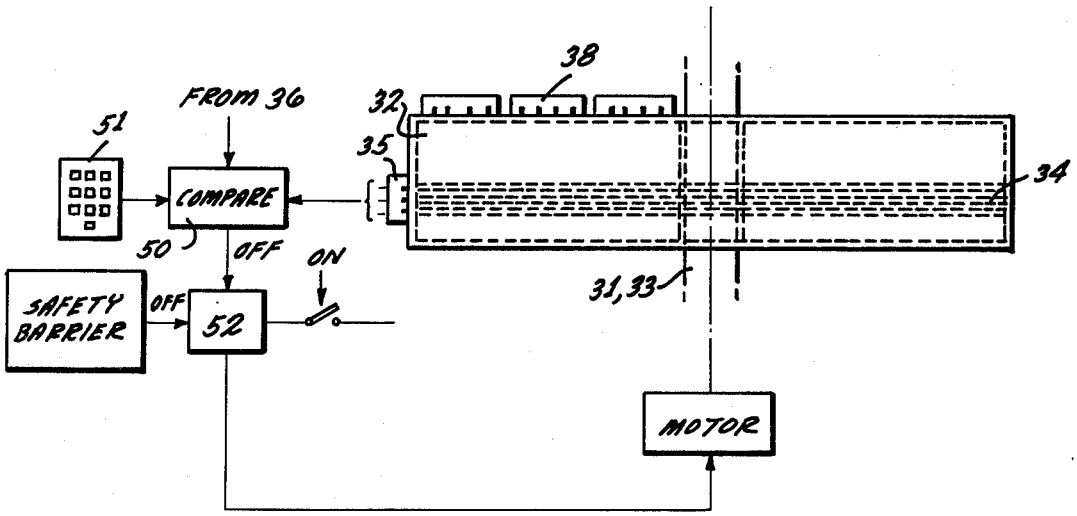
FIG. 9 is a top view of the facility shown in FIG. 8.

FIGS. 8 and 9 illustrate a storage drum with three annular sub-spaces. It can readily be assumed that the cover has been merely omitted for the sake of clarity. The hub-shaft 31 for the drum is constructed as hollow shaft containing the self-locking geared motor 33. The outer periphery of the drum carries three encoding strips or tracks 34 scanned by a three-head transducer 35. The number of strips depends actually on the resolution of the control. The encoding of the strips divides the drum into sections for purposes of control, which may (but does not have to) correspond to the sector partitioning by means of the walls 5.

As indicated schematically, a comparing circuit 50 receives continuously sector-signals from the transducers 35 and compares them with a sector number inputted e.g. by means of a key board 51. Upon agreement the motor is stopped by the control circuit 52, responding to the stop command from the comparing circuit 50.

As stated, the circumferential encoding does not have to correspond to the partitioning sector, but may be much coarser. The control here may be for high speed operation to select one of the sectors at a high speed. The final positioning control may result from use of an additional set of transducers 36, which are arranged radially, and they are used to scan encodings, which identify e.g. individual compartments in a sector. These encodings 37 are provided on the front edges of the partitions 5. The encoding on the front of the compartment walls may have to be changed from time to time particularly if the encoding identifies to some extent the content.

It can readily be seen that these encodings do not have to be limited to identify compartments just by a number, but the encoding may include e.g. numbers which have additional significance. Just by way of example, they may identify zip codes, drawing numbers, due dates or they may identify locations, letters of the alphabet, etc. etc. The same principle may also be employed for the circumferential-sector identification. For example, one may use letter identification for sectors, the letters of course being numerically encoded for reading by the transducers 35 (one may need five tracks in this case) and another criterium is used for the radial encoding.

As shown in FIG. 9, the rear wall of the casing may be provided with ejection devices 38, which are in line with front slots in the casing. As soon as the desired position is obtained, automatically the content of the selected compartment, is, for example, half-way pushed out to be taken out more easily by the user. It may be advisable here to permit partial ejection of the particular partition 5 on which rests the material in the compartment aligned with the access slot. This may be necessary if the papers are loosely stored in the compartment.

One can also see that, for example, one set of compartments may be empty, or even closed completely. The alignment of these compartments with the access slots in the cover or casing defines the zero position of the drum. If in this position the access control device is locked in some fashion (e.g. by a flap on the key board with a lock requiring a special key) then the storage device is protected against unauthorized use of its content. In the case of using a case or enclosure it is readily apparent that a user must not have his (or her) hand in the compartment aligned with the access slot while the drum moves. Thus, the motor control circuit should be under control of feeler switches, light barriers or the like, extending across the access slot and always causing the motor to stop if, for example, the drum still turns while the user has already extended his hand. Also, if a "go" command has been given before the user retracted his hand, the motor control circuit should be maintained disabled until the feeler gives an "all clear" signal. It will be appreciated that objects protruding from the compartments have the same effect.

The advantageous arrangement of office desks and of a storage facility shown in FIG. 10 was already mentioned briefly above. The figure shows two desks 42 and a common store 39. While any of the stores of FIGS. 1 through 6 could be used (note particularly the two side access feature of FIG. 6), FIG. 10 shows specifically a twin drum store 40 with central divider 41. Each desk has, therefore, its own storage facility, merely the housing is shared. The drums may be seated on a common shaft and driven in unison. However, independent rotation may be advisable for reasons of ease of operation, particularly if the store is manually operable. Sharing the drive is permitted in the case of automation of the type described and one will particularly need the access protection feature if both clerks can set the drum into motion.

The storage facility as described is characterized by comparatively small dimensions commensurate with the need for availability. More files and papers can be directly accessed than was heretofore possible which shortens the periods needed for fetching and searching files.

The storage facility was explained primarily with an eye on offices. However, other objects can be stored in that manner, and the store can be incorporated in a vending machine for, e.g. greeting cards, cigarettes, stockings, etc.

The invention is not limited to the embodiments described above, but all changes and modifications thereof not constituting departures from the spirit and scope of the invention are intended to be included.

I claim:

1. Storage facility for papers, files, forms or other objects, comprising:

a hollow storage drum being open on at least one side and including at least two concentric surfaces with means for insertion of partitions at opposite sides;

variably positionable and removable, radially extending partitions inserted in the means of the two surfaces for compartmentizing the interior of the drum;

means for mounting the drum for rotation on a horizontal axis;

an enclosure having at least one slot for access to a compartment of the drum when aligned with the slot;

means connected to the drum for driving the drum;

encoding indicia on the drum for identifying compartments thereof;

scanning means for reaching the indicia and providing reading signals representative thereof;

input means for providing select signals identifying compartments; and comparing means connected to be responsive to the reading signals and the select signals and controlling the means for driving to stop the drum in a particular position upon agreement of the compartments as identified by the indicia as read and by the input means.

2. Storage facility as in claim 1 and including additionally, partitioning means in the drum extending coaxially thereto.

3. Storage facility as in claim 1 and including at least one azimuthally extending divider between two of said partitions.

4. Storage facility as in claim 1 and including a plurality of additional dividers being suspended at and extending radially inwardly from a radially farther one of the two surfaces of said drum and not completely to the other one of the surfaces; and including biasing means connected to the drum for urging a divider of the plurality against a neighboring divide, partition or content in a compartment.

5. Storage facility as in claim 1 and including means for stopping the means for driving in response to accidental access to any compartment during rotation of the drum.

6. Storage facility as in claim 1 and including means for ejecting the content of a compartment when in a particular position.

7. Storage facility as in claim 1, wherein front edges of at least some of the removable partitions are encoded by some of the indicias.

* * * * *